US006168291B1

(12) United States Patent
Rockey et al.

(10) Patent No.: US 6,168,291 B1
(45) Date of Patent: Jan. 2, 2001

(54) LUMINAIRE MOTORIZED SHADE (DOUSER) MECHANISM

(75) Inventors: Noah N. Rockey, Minnetonka; Jim J. Frensko, Waconia; Johann A. Toikka, Minnetonka; John B. Grunloah, Lester Prairie, all of MN (US)

(73) Assignee: Sterner Lighting Systems Incorporated, Eden Prairie, MN (US)

( * ) Notice: Under 35 U.S.C. 154(b), the term of this patent shall be extended for 0 days.

(21) Appl. No.: 09/152,923

(22) Filed: Sep. 14, 1998

(51) Int. Cl.[7] ..... F21V 1/08

(52) U.S. Cl. ..... 362/278; 362/280; 362/320; 362/319; 362/351; 169/238; 169/239; 169/315

(58) Field of Search ..... 362/16, 18, 277, 362/278, 280, 276, 317–320, 351; 160/1, 7, 133, 181, 188, 189, 192, 238, 234, 309–315, 904, 907

(56) References Cited

U.S. PATENT DOCUMENTS

| | | | | |
|---|---|---|---|---|
| 77,499 | * | 5/1868 | Legg | 160/254 |
| 260,933 | * | 7/1882 | Brasill | 362/167 |
| 1,606,152 | * | 11/1926 | Douglas | 362/321 |
| 3,016,454 | | 1/1962 | Simms | 240/46.03 |
| 4,052,607 | * | 10/1977 | Larson | 362/18 |
| 4,510,708 | * | 4/1985 | Pokrinchak | 40/361 |
| 4,519,020 | * | 5/1985 | Little | 362/268 |
| 4,712,167 | | 12/1987 | Gordin et al. | 362/233 |
| 4,775,918 | * | 10/1988 | Snyder | 362/18 |
| 5,010,459 | | 4/1991 | Taylor et al. | 362/85 |
| 5,293,306 | * | 3/1994 | Bamber | 362/186 |
| 5,406,176 | | 4/1995 | Sugden | 315/292 |
| 5,681,103 | | 10/1997 | Remilard et al. | 362/32 |

* cited by examiner

*Primary Examiner*—Stephen Husar
*Assistant Examiner*—Ismael Negron
(74) *Attorney, Agent, or Firm*—Westman, Champlin & Kelly, P.A.

(57) ABSTRACT

A luminaire motorized shade or douser mechanism includes a lamp mounted within a reflector and a motorized shade unit that opens and closes in front of the lens of the reflector. The shade unit includes a motor, two rollers, two guide cables, a sheet of opaque flexible material or fabric, and an aluminum frame. The motor drives the roller to run the shade in front of the lens to cover it and also to uncover. The motorized shade or douser mechanism is used to effectively block the light emitting from the lamp and create a condition whereas no light leaves the lens of the luminaire.

6 Claims, 5 Drawing Sheets

LUMINAIRE MOTORIZED SHADE (DOUSER) MECHANISM

BACKGROUND OF THE INVENTION

The present invention relates to a remotely operated, powered shade or douser device mounted to the face of a light fixture so it can be moved across a lens to cover it.

Lighting devices with incandescent or arc discharge lamps have been provided with reflectors for many years. It is often desired to have an electromagnetic radiation source (a lamp) that radiates electromagnetic radiation in the visible spectrum (light). This combination of the lamp and the reflector is used to provide the lighting for sports arenas, sports stadiums and other commercial and industrial application.

In many applications, the electromagnetic radiation is derived from a plasma arc formed within an electromagnetic transmissive envelope or arc tube. One form of such an arc discharge lamp is a metal halide lamp. In such lamps, the arc is ignited between two electrodes placed at opposite ends of the electromagnetic transmissive envelope. These electrodes define an envelope axis and are connected to a power supply, which supplies the proper voltage and current for starting and operating the lamp. When power is removed from an operating metal halide lamp, it requires approximately fifteen minutes to re-strike, using normal voltages, and an additional five minutes to reach a stable color temperature and light output.

In certain lighting venues, such as arenas or stadiums, it is desirable to have the entire lighted area go dark. Such instances are used for player introductions, half-time shows, and special events. Prior applications have used a special instant re-strike lamp and ignitor system, which hits the system with a large voltage pulse to re-ignite the lamp. Even though it is called an "instant" re-strike system, this system takes several minutes for the light to come back to a full luminous output and full color rendering.

Other prior applications have used a mechanical device consisting of motor driven metal louver blades or clam shell devices that are moved into position in front of the lamp and reflector system to effectively block the transmission of light. This type of application can interfere with the projected beam of light causing a depreciation in light output which requires a higher total connected load to provide effective lighting levels. This type of application may also require more clearance around the luminaire to effectively mount the luminaire and shutter device such that there is no interference with surrounding fixtures.

The present invention arises from the fact that the instant re-strike system is lacking in several areas and the realization that the motorized metal louver blades cause a depreciation in light levels and require more mounting space.

SUMMARY OF THE INVENTION

The present invention includes a reflector and typically an arc discharge lamp mounted in the reflector, a frame and a motorized shade or douser mechanism. The shade or douser material is rolled onto a top roller with a reversible motor to an open position, increasing the tension of a bottom spring loaded take-up roller via one or more cables. When the motor is reversed, the tension in the spring on the bottom roller causes the rolled or coiled shade or douser to unwind and thus, the bottom roller and cables pull the shade or douser material in front of the lens. The cable, preferably an aircraft cable, is rolled onto the bottom roller until the shade or douser is in the closed position. The bottom roller continues to provide tension on the shade or douser when it is in the closed position, to hold the material taut.

The design also includes a bottom to top or a side to side application. The fabric used is a heat resistent material with a bar sewn into the fabric to provide even distribution of the torque required to roll and unroll the material. The edge of the shade or douser material is attached to stainless steel aircraft cable at two separate locations to ensure that the material stays within its frame.

DETAILED DESCRIPTION OF THE PREFERRED EMBODIMENTS

Figure 1:
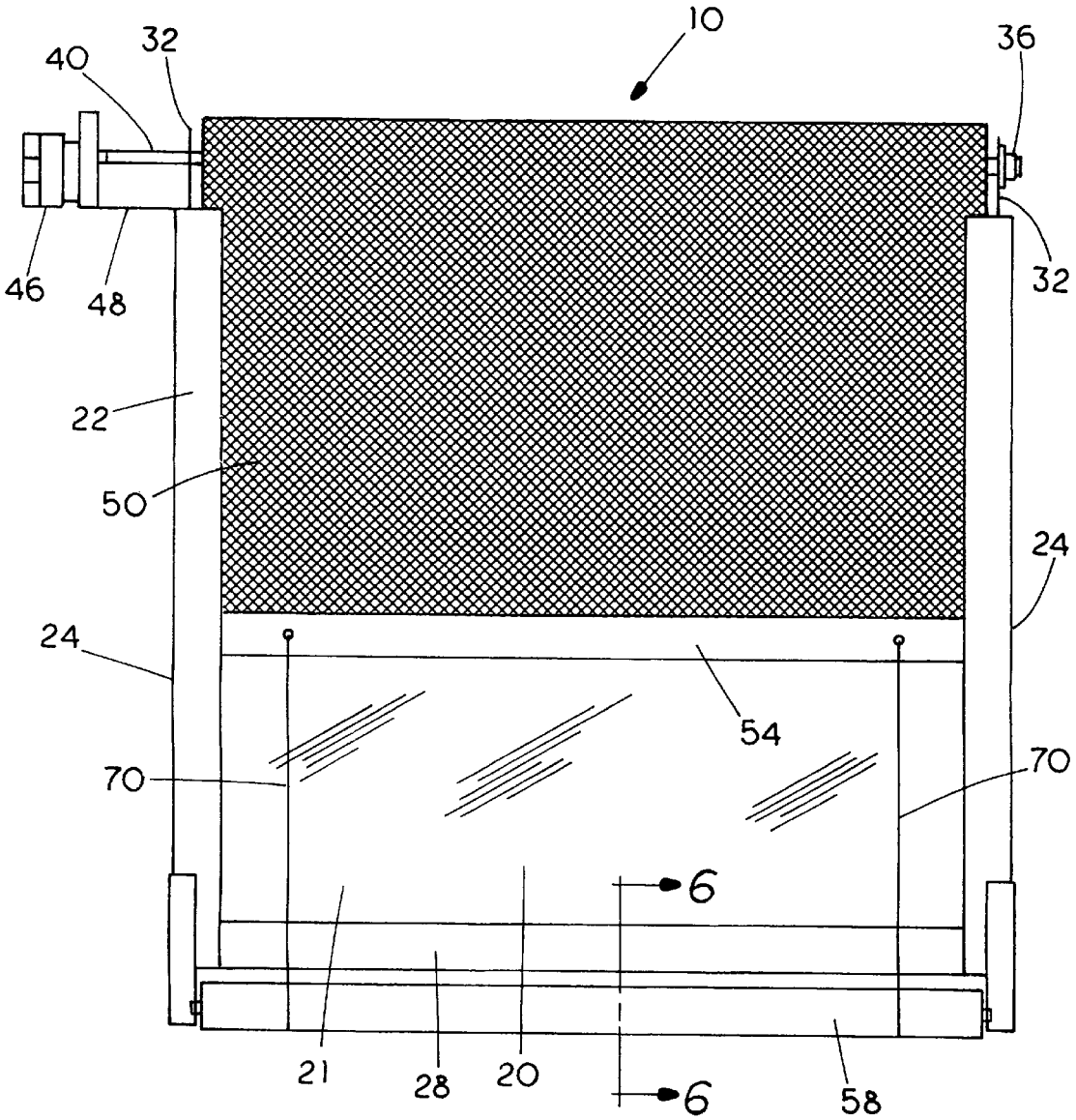
FIG. 1 is a front view of a luminaire having a motorized shade or douser of the present invention thereon, in a half closed position.
Figure 2:
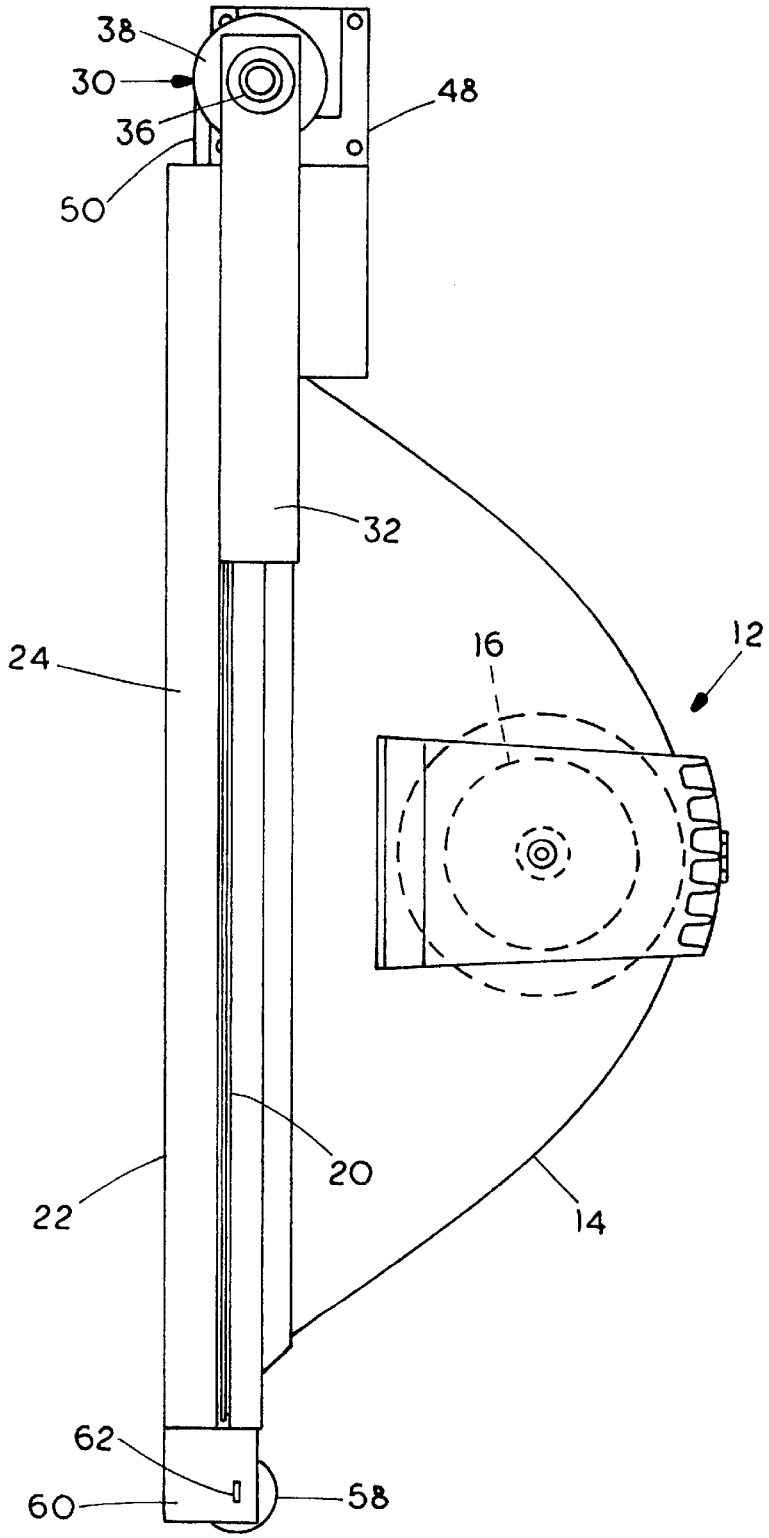
FIG. 2 is a side view of the luminaire with the motorized shade or douser in place.
Figure 3:
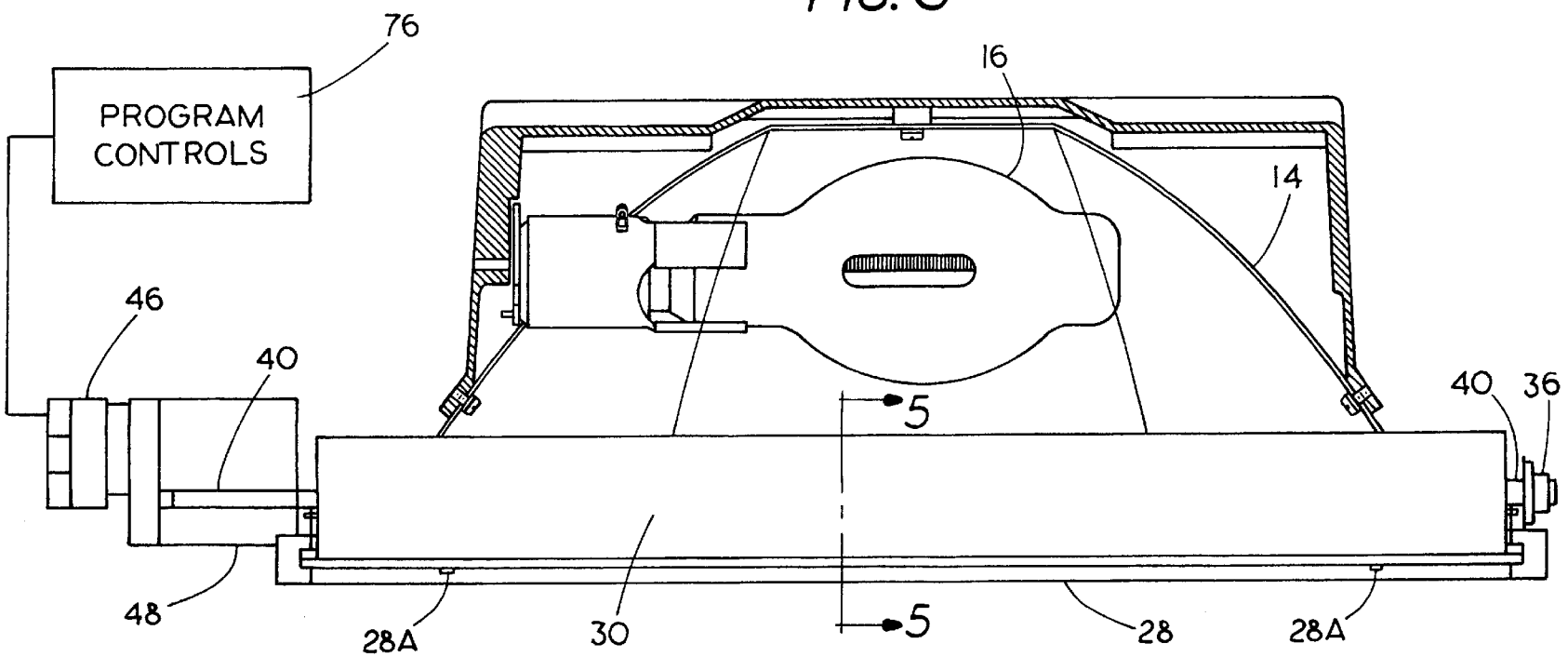
FIG. 3 is a top plan view of the motorized shade or douser with the luminaire housing shown in cross section.

Referring to the drawings, FIG. 1 is a front view of a motorized shade or douser 10 made according to the present invention mounted onto a luminaire housing 12. The luminaire housing includes a reflector 14, and a light source 16 arranged in a desired manner to project light out through a front lens 20 shown partially in FIG. 1. The motorized shade or douser device includes a frame 22 that is made to mount onto the housing 12 in a suitable manner, such as with screw fasteners. The frame 12 surrounds the lens 20 and opening 21 covered by the lens 20.

Figure 5:
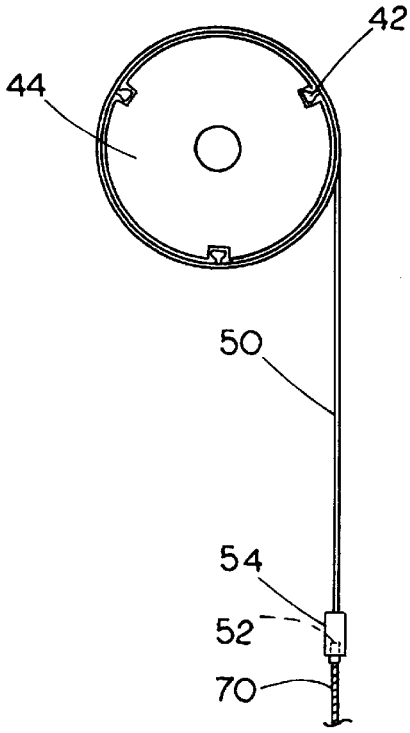
FIG. 5 is a sectional view taken on line 5—5 in FIG. 3.
Figure 6:
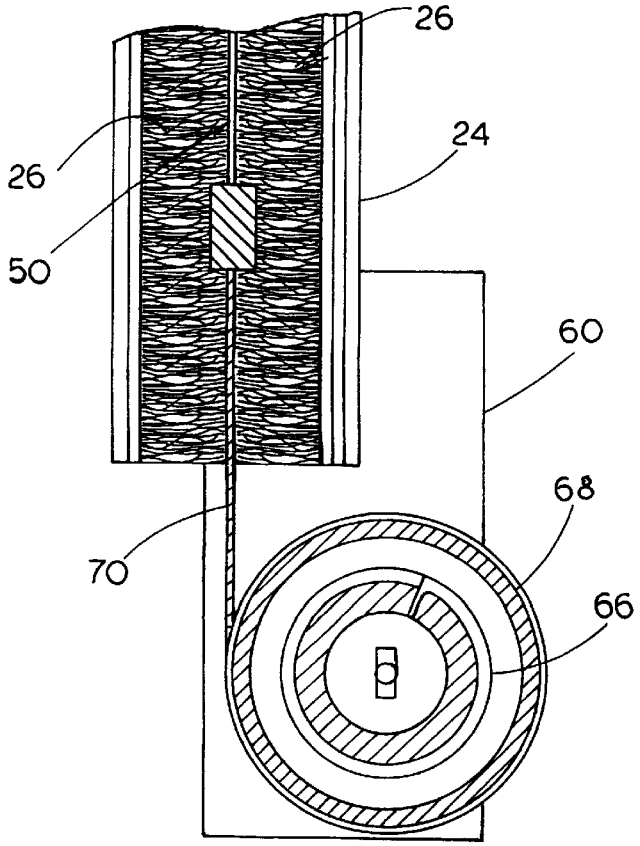
FIG. 6 is a sectional view taken on line 6—6 in FIG. 1.

Frame 22 includes upright channel frame members 24 on opposite sides thereof that have longitudinally extending brush strips 26 (see FIG. 6) on the interior. One or more strips can be used. A lower channel cross frame member 28 joins the upright frame members 24. The upper ends of the upright frame members support a roller assembly 30, which is rotatably mounted on downwardly depending frame legs 32 that join the upright frame members 24. The legs 32 support suitable bearings 36 to mount a shade or douser roller 38. The roller 38 has a central drive shaft 40 extending through a tubular shell 42 (see FIG. 5). The shaft 40 is held in position in the shell with suitable end caps 44. The drive shaft 40 is driven by a reversibly controllable motor 46 mounted onto a motor bracket 48 on the frame member 24 on one side of the frame.

Figure 4:
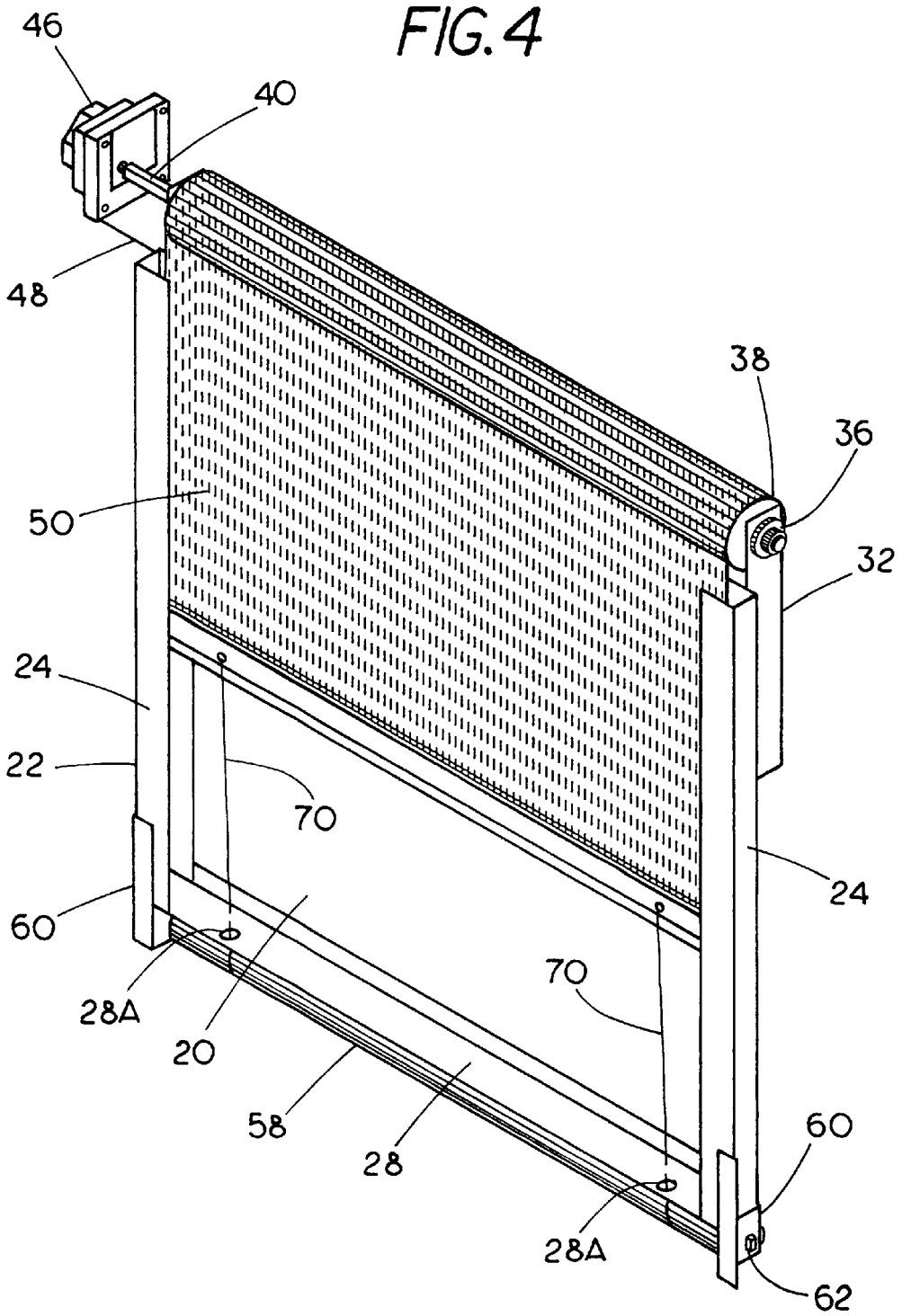
FIG. 4 is an isometric view of the motorized shade or douser in a half closed position.

A flexible material of fabric or douser sheet 50 forms a shade and is rolled onto the roller shell or tube 42. The sheet 50 has a free control edge 52 on which a reinforcing bar 54 is mounted (see FIG. 5). At the lower end of the frame 22, which is the side opposite from the roller 38, a spring loaded take-up roller 58 is mounted on end brackets 60 which connect to the upright frame members 24. The spring loaded take-up roller 58 is made like a window shade roller, and has opposite end caps that are mounted in the brackets 60, 60 as can be seen in FIG. 4. The end portion 62 is flattened to a rectangular shape to hold one end of a torsion spring shown at 66 in FIG. 6. The torsion spring 66 is on the interior of the tube 68 forming part of the take-up roller and has one end anchored to the tube. The tube 66 is mounted so it will rotate relative to the end portion 62 to create load in the torsion spring. The take-up roller has a pair of control cables 70 anchored thereon, which are wound on the roller 58 and which will unwind from roller 68 as the roller 38 is rotated by the motor 46 which creates tension on the cables 70, 70. As the cables 70, 70 unwind, the spring 66 is loaded to tend to rewind the roller 58. The spring 66 will pull on the cables 70, 70 and thus, the cables wind up as the motor 46 is stepped in reverse, to permit the shade or douser 50 to unwind from roller 38.

The cross-member 28 has holes 28A for providing a path for the cable 70, 70.

The brush strips 26 that are provided on the frame members 24, as well as on the bar 54 are for light sealing along the edges of the shade or douser 50. The shade or douser material is an opaque fabric, that is of sufficient length to cover the entire lens 20 in the opening of the frame when the shade or douser is in its lowered position.

There is a pre-load on the torsion spring 66 so that with the shade fully extended covering the lens, the spring 66 still exerts a force on the shade or douser to keep it taut and in place to completely cover the lens 20. No light from the light source 16 will pass through the shade or douser fabric and with all luminaires in an arena covered with the shade or douser, the arena can be made totally dark.

The motor 46 can be connected suitably to the shaft 40 through a drive coupling, and when the motor is driven clockwise when viewed in FIG. 4, for example, it will wind the opaque flexible material shade or douser 50 onto the upper roller assembly 30 and the cables 70, 70 will extend, placing greater tension on the shade or douser through torsion spring 66 of the take-up roller assembly 58. The motor 46 is connected through an anti-reverse gear box or else is made so it will hold the shade or douser in position and tension on the cables 70 will not extend the shade or douser unless the motor is driven in reverse. When the motor 46 is energized through the programmed controls 76, and the motor is driven in reverse through steps (it is preferably a stepper motor) in counterclockwise direction as shown in FIG. 4, the cables 70, 70 will extend the shade or douser 50 a desired amount over the lens 20. In FIG. 4, the shade is half open, to provide a selected amount of light through the remaining portion of the lens 20. The shade can be moved to close the lens opening as much as desired, including totally covering the lens opening. The brush strips that have been mentioned will provide light sealing along the edges.

The shade or douser 50 will be in alignment overlying the luminaire lens 20 so that it can be moved to completely block any light. As mentioned, when total darkness in an arena is desired for particular portions of a program, the shade or douser is used to block all light and the luminaire can remain on and does not have to be restarted.

The shade or douser assembly can be mounted on to existing luminaires by making the frame as a separate unit, as shown in FIG. 4, and merely supporting it with suitable screws, channels or extra brackets to the existing housings of luminaires. Compressible gaskets can be used for sealing light leaks. The shade assembly takes less room than motorized louver blades, and does not block any light when fully retracted.

The program control, indicated at 76, can be a computerized program control, or a manually selected program that would be timed, after initiation, to open or close the shade or douser 50 as desired for obtaining the correct amount of illumination from each of the luminaires used.

The program control 76 can have a central program that would control a number of luminaires, each having a shade or douser assembly made according to the present invention.

The motorized shade or douser assembly provides a light-dimming system, that is easily used and programmed, and relatively simple to make and install. Further, it is essentially fool-proof, having few moving parts.

Although the present invention has been described with reference to preferred embodiments, workers skilled in the art will recognize that changes may be made in form and detail without departing from the spirit and scope of the invention.

What is claimed is:

1. A light intensity control for a luminaire light housing having a light opening, comprising:

a flexible sheet of material of size to cover the light opening;

a first roller mounted on a first side of the housing for rolling and unrolling the flexible sheet, the flexible sheet having an edge that is substantially parallel to the roller and extends laterally across the opening and moves across the opening as the flexible sheet is unrolled to cover the opening;

a reinforcing member coupled to the edge of the flexible sheets;

a tension-creating member mounted on a second opposite side thereof for exerting a tension on the flexible sheet; and a motor connected to the first roller for controllably rotating the first roller against the force of the tension creating member such that the flexible sheet is caused to cover and uncover the opening;

said tension-creating member comprising:

a second roller on the second opposite side of the housing;

a spring urging said second roller to rotate in a first direction; and a flexible link connected to exert forces on the flexible sheet through the reinforcing member coupled to the edge of the flexible sheet and winding onto and off said second roller as the first roller is controllably rotated by said motor, the flexible link being narrow so it does not substantially obstruct the opening.

2. The light intensity control of claim 1, and a programmable control for controlling the motor in accordance with a desired program.

3. The light intensity control of claim 1 wherein the flexible sheet is opaque.

4. The light intensity control of claim 1 wherein the motor is a stepper motor, and the tension creating member provides a constant force tending to rotate the first roller in a direction to unroll the flexible sheet from the first roller.

5. A luminaire and light control assembly comprising;

a luminaire housing having an opening and a lens over the opening, and an assembly including portions for covering the lens, the assembly having a first roller mounted on a first side of the lens;

a motor for driving the first roller in opposite rotational directions;

an opaque flexible material sheet mounted to wind on the first roller and being of size to extend to a second opposite side of the lens and of width to extend laterally to cover the lens, the flexible material sheet having a reinforcement portion on an edge thereof, which edge extends across the lens, the motor being driveable to roll and unroll the flexible material sheet;

a flexible link having one end connected to the reinforcement portion on the edge of the flexible material sheet;

and a spring loaded roller on an opposite side of the opening from the first roller, an opposite end of the flexible link being connected to the spring loaded roller and the flexible link winding onto the spring loaded roller to pull the edge of the flexible material sheet from the first roller as the first roller is moved in a direction to unroll the flexible material sheet under control of the motor, and the flexible link unwinding from the spring loaded roller to permit the first roller to be driven to roll the flexible material sheet thereon, whereby the flexible material sheet covers and uncovers the lens under control of the motor and the spring loaded roller.

6. A light intensity control for a luminaire light housing having a light opening comprising:

a flexible sheet of material of size to cover the light opening;

a frame;

a first roller mounted on the frame on a first side of the housing for rolling and unrolling the flexible sheet;

a tension-creating member mounted on a second opposite side of the housing for exerting a tension on the flexible sheet; and a motor connected to the first roller for controllably rotating the first roller against the force of the tension creating member such that the flexible sheet is caused to cover and uncover the opening;

said frame having side members for guiding edges of said flexible sheet; and light sealing brushes mounted in said side members for engaging and preventing light from escaping along the side edges of said flexible sheet.

* * * * *

UNITED STATES PATENT AND TRADEMARK OFFICE

CERTIFICATE OF CORRECTION

PATENT NO. : 6,168,291 B1
DATED : January 2, 2001
INVENTOR(S) : Noah N. Rockey et al.

It is certified that error appears in the above-identified patent and that said Letters Patent is hereby corrected as shown below:

Item [56] References Cited, U.S. PATENT DOCUMENTS,
Please add the following references:

OTHER PUBLICATIONS

Catalog page of Payne Sparkman LiteShades (one page), published July of 1996.

Specification pages of the Payne Sparkman LiteShades (two pages), published August of 1996.

Signed and Sealed this

Fifteenth Day of January, 2002

*Attest:*

*Attesting Officer*

JAMES E. ROGAN
*Director of the United States Patent and Trademark Office*